US007618206B2

(12) United States Patent
Sacks

(10) Patent No.: US 7,618,206 B2
(45) Date of Patent: Nov. 17, 2009

(54) CLEANING DEVICE

(75) Inventor: Roland Sacks, Bubikon (CH)

(73) Assignee: AVET. AG

( * ) Notice: Subject to any disclaimer, the term of this patent is extended or adjusted under 35 U.S.C. 154(b) by 533 days.

(21) Appl. No.: 11/372,924

(22) Filed: Mar. 11, 2006

(65) Prior Publication Data

US 2006/0204316 A1 Sep. 14, 2006

Related U.S. Application Data

(63) Continuation-in-part of application No. 11/359,717, filed on Feb. 22, 2006, now Pat. No. 7,431,524.

(30) Foreign Application Priority Data

Mar. 14, 2005 (DE) ..... 20 2005 004 060 U

(51) Int. Cl.
*A47L 1/08* (2006.01)
*A47L 13/26* (2006.01)
*A46B 11/00* (2006.01)
*B05B 1/00* (2006.01)

(52) U.S. Cl. ..... 401/138; 401/137; 401/139; 401/268; 239/597

(58) Field of Classification Search ..... 401/136–140, 401/263, 268; 239/597–599
See application file for complete search history.

(56) References Cited

U.S. PATENT DOCUMENTS

| | | | | |
|---|---|---|---|---|
| 7,128,283 | B1 * | 10/2006 | Shahin | 239/600 |
| 7,316,362 | B2 * | 1/2008 | Miyauchi | 239/102.1 |
| 2004/0076463 | A1 * | 4/2004 | Hall et al. | 401/140 |
| 2005/0058500 | A1 * | 3/2005 | Hall et al. | 401/140 |
| 2008/0169028 | A1 * | 7/2008 | Moore | 137/15.04 |

* cited by examiner

*Primary Examiner*—David J. Walczak
*Assistant Examiner*—Ryan Varnum
(74) *Attorney, Agent, or Firm*—Robert M. Schwartz; David W. Barman

(57) ABSTRACT

A cleaning device includes a support shaft; a retaining plate connected to a distal end of the support shaft by pivot elements; a cleaning pad detachably secured to a lower surface of the retaining plate; a fluid reservoir attached to the support shaft; and a flat jet spray assembly secured upon the upper surface of the retaining plate within its perimeter. The flat jet spray assembly includes a spray head having a securing flange with an inclined base at the rear portion; and a front portion having a slot-shaped spray jet outlet being open at side edges and a channel around a center of, and in perpendicular to, the slot-shaped spray jet outlet; a spray nozzle disposed within the channel, which has a horizontal emission slit; and a fluid feed tubing connected between the fluid reservoir and the spray nozzle.

21 Claims, 10 Drawing Sheets

CLEANING DEVICE

CROSS REFERENCE TO RELATED APPLICATION

This application claims foreign priority benefits under 35 USC §119(a)-(d) or §365(b) of German Utility Model No. 20 2005 004 060.6, filed on Mar. 14, 2005. This application is also a Continuation-in-part of patent application Ser. No. 11/359,717, filed on Feb. 22, 2006, which is incorporated by reference herein in its entirety.

FIELD OF INVENTION

The present invention relates to a cleaning device, or flat mop, with a retaining plate serving as a carrier for cleaning cloths, mops, and similar cleaning elements, which is connected with a rod or similar handling device, as well as with a flat jet spray assembly attached to the retaining plate for the emission of cleaning fluid.

BACKGROUND OF INVENTION

Cleaning devices are already known which, by means of an emission device, emit cleaning fluid out of an outlet aperture onto the area of the floor located in front of the retaining plate. With a cleaning cloth arranged at the retaining plate, the cleaning fluid, which can also contain a disinfectant fluid or is such a fluid, can be distributed onto the floor (DE 100 40 014 A1). The flat surface distribution of the cleaning fluid emerging from the outlet aperture, however, still requires substantial expenditure of time and labor.

A cleaning device is therefore also known from DE 102 29 327 A1 which has a fluid outlet which is designed as a spray strip, which has several outlet apertures distributed over the longitudinal extension of the strip. As a result of this, the cleaning fluid can be applied in linear fashion, and the effort required for distributing the cleaning fluid can be reduced. The spray strip is arranged close to the floor, on at least one longitudinal edge of the retaining plate, and therefore close to the cleaning area, with the result that the risk pertains of the outlet apertures of the spray strip rapidly becoming dirty, and replacement or cleaning becoming necessary. In addition, the spray strip extending beyond the spray area may become damaged in the course of its longitudinal extension during the use of the cleaning device, for example under low items of furniture or in the area of other obstacles, so that a uniform distribution of the cleaning fluid is impaired.

Generic cleaning systems of the type in which the present invention spray head assembly may be used appear in U.S. Pat. No. 6,986,618 to Hall, et al. Flat jet nozzles are also known in the art, however, primarily for use in high pressure cleaning of stone and other dense surfaces of building exteriors. This is reflected in U.S. Pat. No. 4,307,840 to Schulze; U.S. Pat. No. 5,037,032 to Graef; U.S. Pat. No. 5,597,122 to Eisenmann; and U.S. Pat. No. 5,833,148 to Steinhilber. No art comparable in structure or function to the present assembly is known to the inventor.

A need therefore exists for a cleaning device of the type referred to with which the application and distribution of cleaning fluid can be carried out in a time-saving and convenient manner, which can be manufactured with little effort, can be easily fitted, and can also be used in confined spaces with obstacles and in severely dirt-contaminated areas which are to be cleaned.

SUMMARY OF THE INVENTION

In one embodiment, the present invention is directed to a flat jet spray assembly for providing a flat jet spray on a flat mop. The flat jet spray assembly comprises a spray head comprising a securing flange at a rear portion thereof; and a front portion having a slot-shaped spray jet outlet being open at side edges and a channel around a center of, and in perpendicular to, the slot-shaped spray jet outlet; a spray nozzle having a horizontal emission slit; the spray nozzle disposed within the channel of the spray head; and a fluid feed tubing having an outlet connecting to the spray nozzle, and having an inlet connecting to a fluid supplier. The flat jet spray assembly is secured upon an upper surface of a flat mop head. The securing flange of the spray head can an inclined base, and the angle between the inclined base and the horizontal ground can be used to control spray width of the flat jet spray assembly.

In a further embodiment, the present invention is directed to a cleaning device, which comprises a support shaft; a retaining plate connected to a distal end of the support shaft by pivot means; a cleaning pad detachably secured to a lower surface of the retaining plate; a fluid reservoir attached to the support shaft, for storing cleaning fluid; and the flat jet spray assembly as described above, secured upon the upper surface of the retaining plate within a perimeter thereof.

It is an object of the invention to provide a cleaning device by which the application and distribution of cleaning fluid can be carried out in a time-saving and convenient manner, which can be conveniently manufactured and can be easily fitted, and can also be used in confined spaces with obstacles and in severely dirt-contaminated areas which are to be cleaned.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
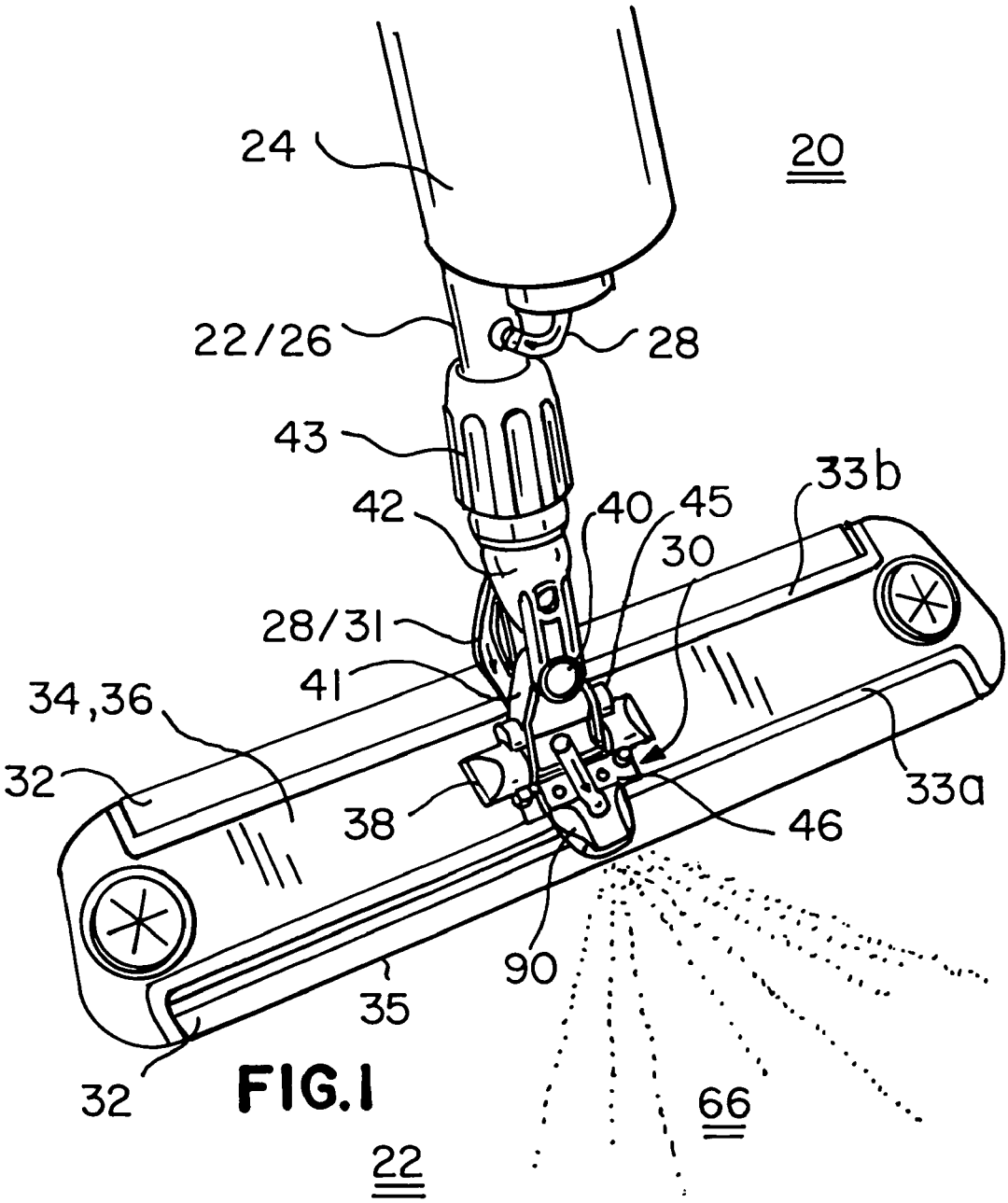
FIG. 1 is a top operational view of a distal end of a flat mop with which the inventive flat jet spray assembly is employed.

In one embodiment, the present invention provides a cleaning device, more particularly a flat mop. As shown in FIGS. 1-3 and 4, flat mop 20 comprises a support shaft 22, a retaining plate 34 connected to a distal end 26 of support shaft 20 by pivot means; a cleaning pad 80 detachably secured to a lower surface of retaining plate 34; a fluid reservoir 24 attached to support shaft 22 for holding fluid 28; and a flat jet spray assembly 30 secured upon upper surface 36 of retaining plate 34. Retaining plate 34 is also commonly referred to as flat mophead.

Figure 2:
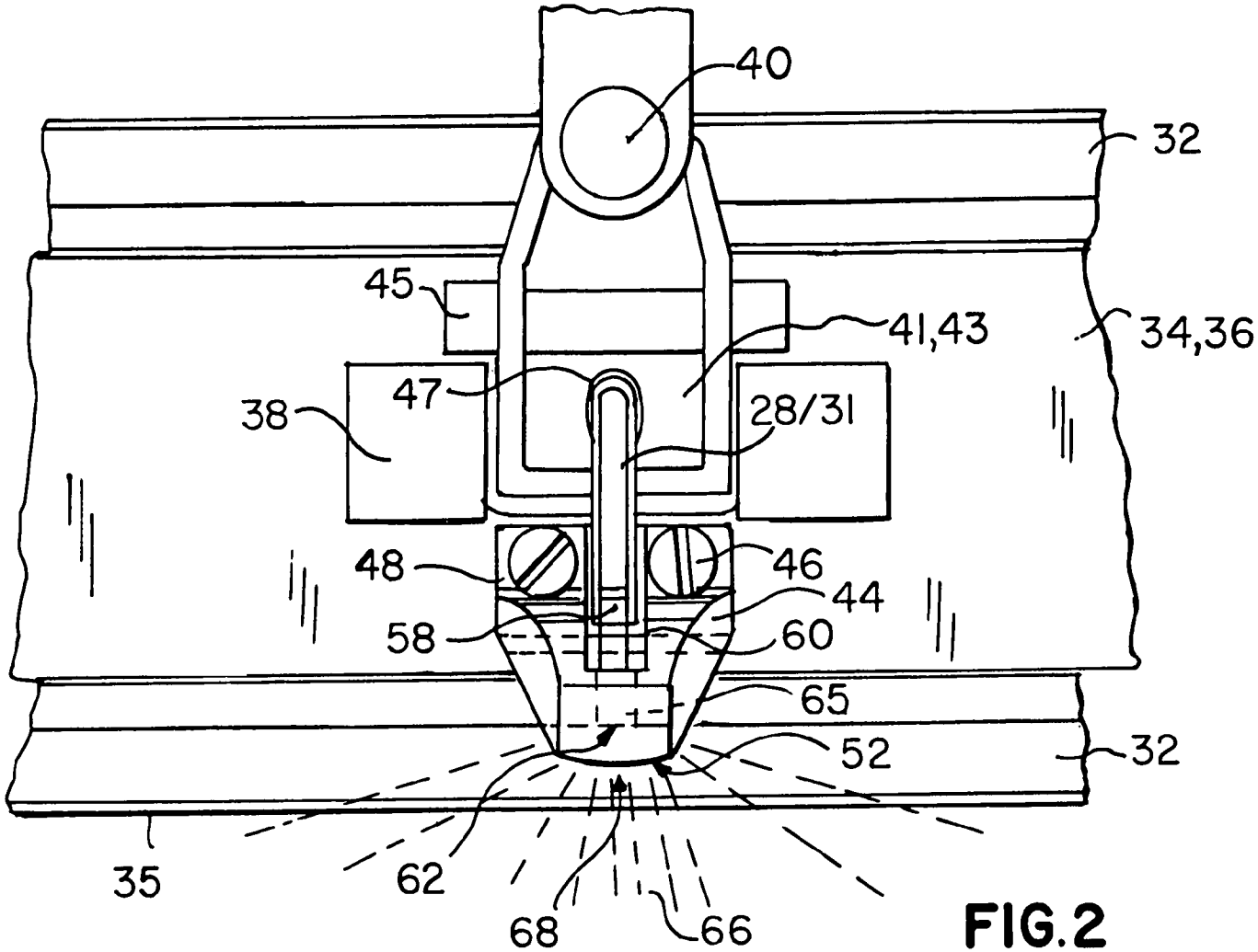
FIG. 2 is a top view of the flat jet spray assembly, retaining plate and the pivot means of one embodiment of the present invention.
Figure 3:
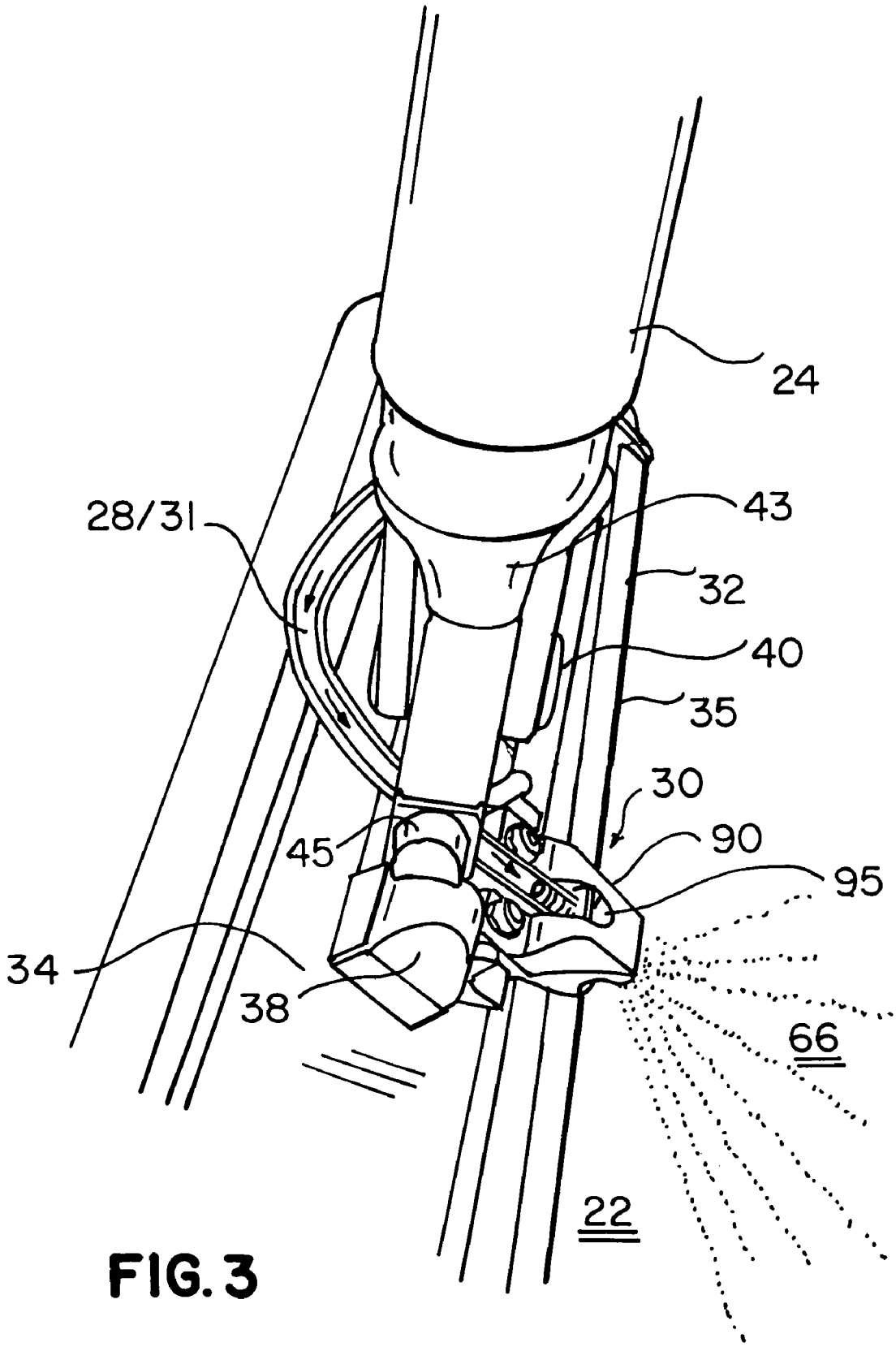
FIG. 3 is a diagonal view of FIG. 1 showing in greater detail the passage of fluid from the fluid reservoir to the spray nozzle of the flat jet spray assembly.
Figure 4:
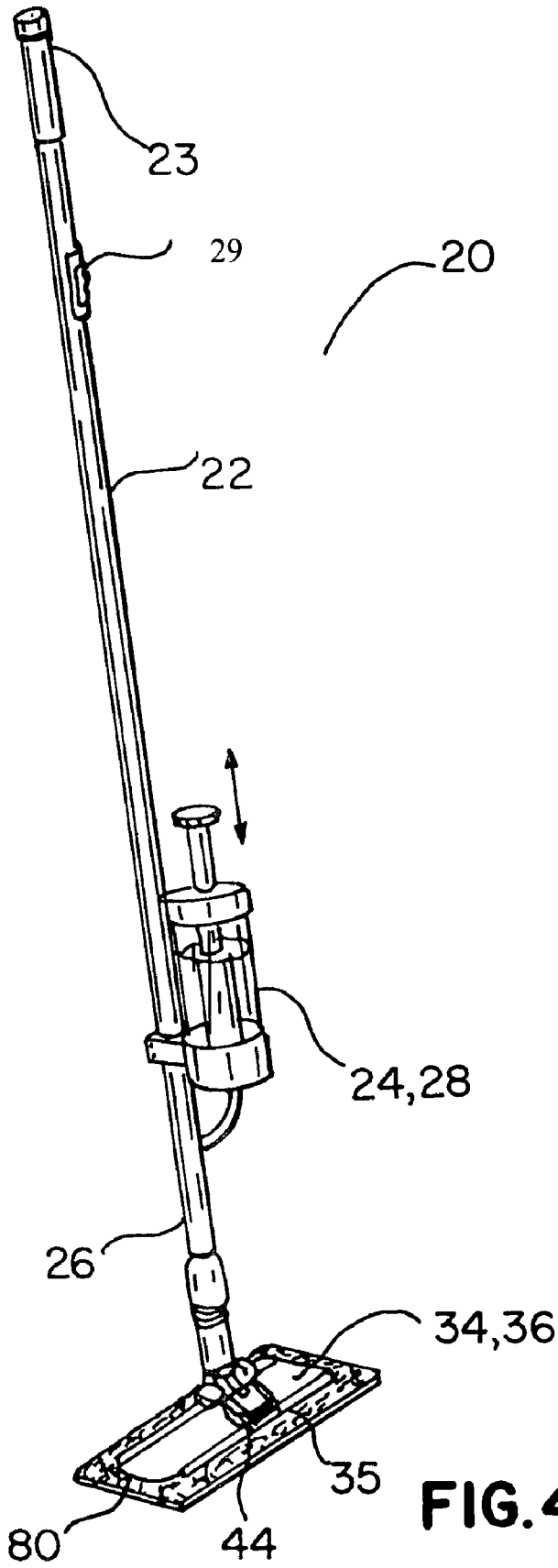
FIG. 4 is a schematic view of the flat mop of the present invention.

Further shown by FIGS. 1-3 is the connection mechanism between retaining plate 34 and support shaft 22, which includes a retaining element 38, a vertical pivot joint 41. retained by retaining element 38, a horizontal pivot joint 40 connected to the upper portion of vertical pivot joint 36, and a shaft mount 43 connected to upper portion 42 of horizontal pivot joint 40. Distal end 26 of support shaft 22 is secured into shaft mount 43. As shown in FIG. 4, a flat cleaning pad 80 is attached to the lower surface of retaining plate 34. Preferably, cleaning pad 80 is made of microfiber which can be washed for more than 300 times. In one embodiment, a layer of loop material is sewed on the upper side of cleaning pad 80; and there is a strip of hook material secured along the bottom side of each edge strip 32. Cleaning pad 80 is detachably attached to the lower surface of retaining plate 34 by a hook-loop connection. Reservoir 24 can include a manual pump, or mechanical pump, which can be activated by switch 29 adjacent to proximal end 23 of support shaft 22.

Flat jet spray assembly 30 comprises a spray head 44 or 90, a spray nozzle 58 disposed within the spray head and a fluid feed tubing 31 fluidly connecting spray nozzle 58 and fluid reservoir 24.

Figure 5:
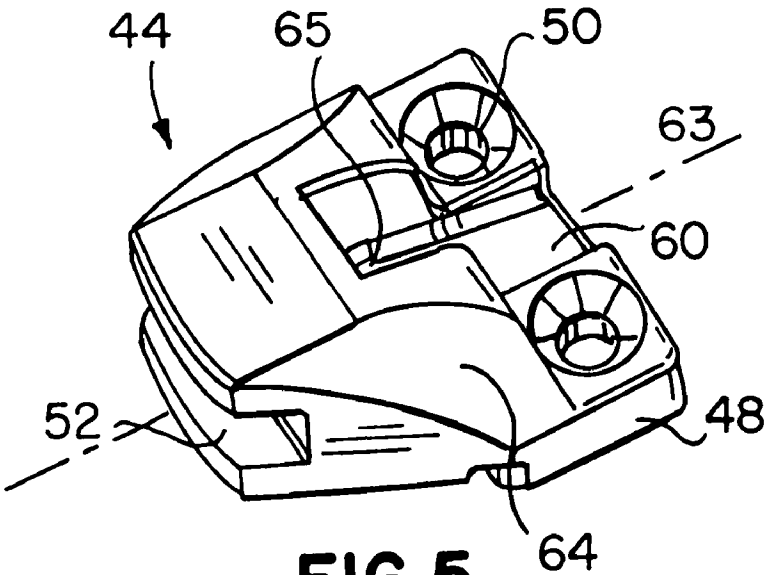
FIG. 5 is a perspective view of the spray head in one embodiment of the present invention.
Figure 5A:
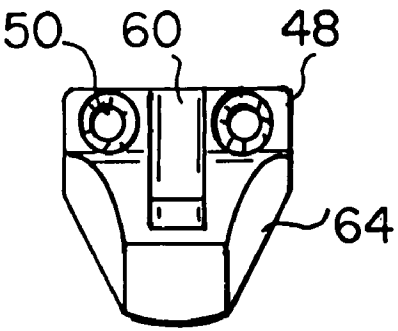
FIGS. 5A-5C are a top elevational view, a front plan view and a side elevational view of the spray head of FIG. 5, respectively.

As shown in FIGS. 1-3, spray head 44 or 90, approximately central in the longitudinal extension of retaining plate 34, is arranged in front of retaining element 38 and inside the outline contour or perimeter of retaining plate 34. The width of spray head can be of equal width or narrower than retaining element 38. Because of this arrangement, and also due to the small dimensions of the spray head, this is well protected against damage. The spray head can, for example, have external dimensions with a width of about 30 mm, a depth of about 30 mm, and a height of about 15 mm. Preferably, the width of spray head 44 or 90 is substantially less than the width of retaining element 38. When the cleaning pad is attached, the front end 55 or 93 of spray head 44 or 90, respectively, in the direction of spraying, is at a distance from the front edge of cleaning pad 80, for example 1.0 to 2.5 cm. This distance substantially reduces the dirt contamination of spray nozzle 58. As shown in FIGS. 5 and 6B, spray head 44 or 90 can be designed as a plate-shaped flat part. Therefore, the spray head does not project forward or upward in an interfering manner at any point, with the result that it is well protected against damage and functional disturbances are avoided. Due to the structure and arrangement of the spray head, problem-free cleaning under low items of furniture is also practical.

Figure 8:
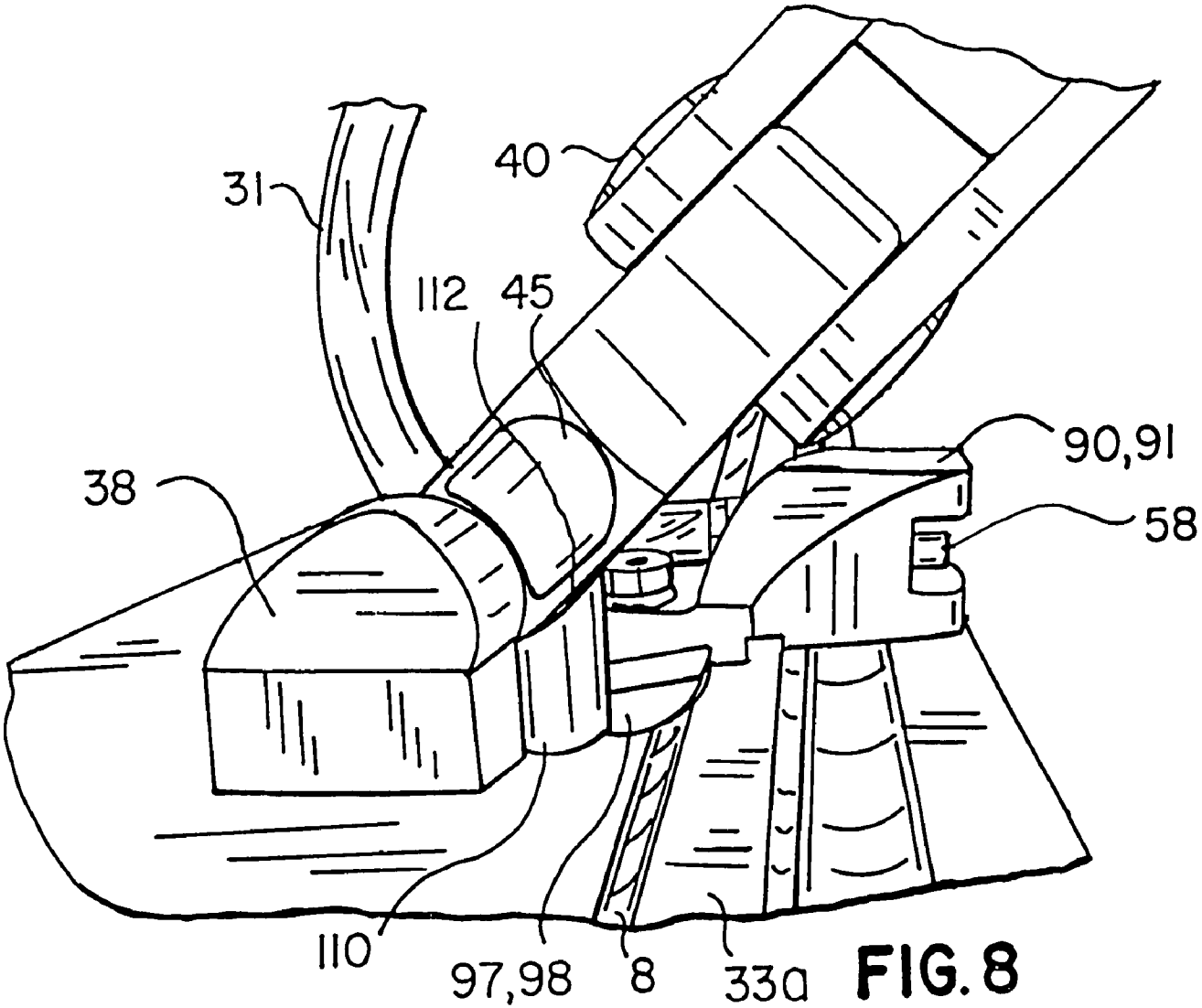
FIG. 8 is a side view of flat jet spray assembly installed on the retaining plate showing the interface between the securing flange of the spray head and the front rim of retaining plate.
Figure 9:
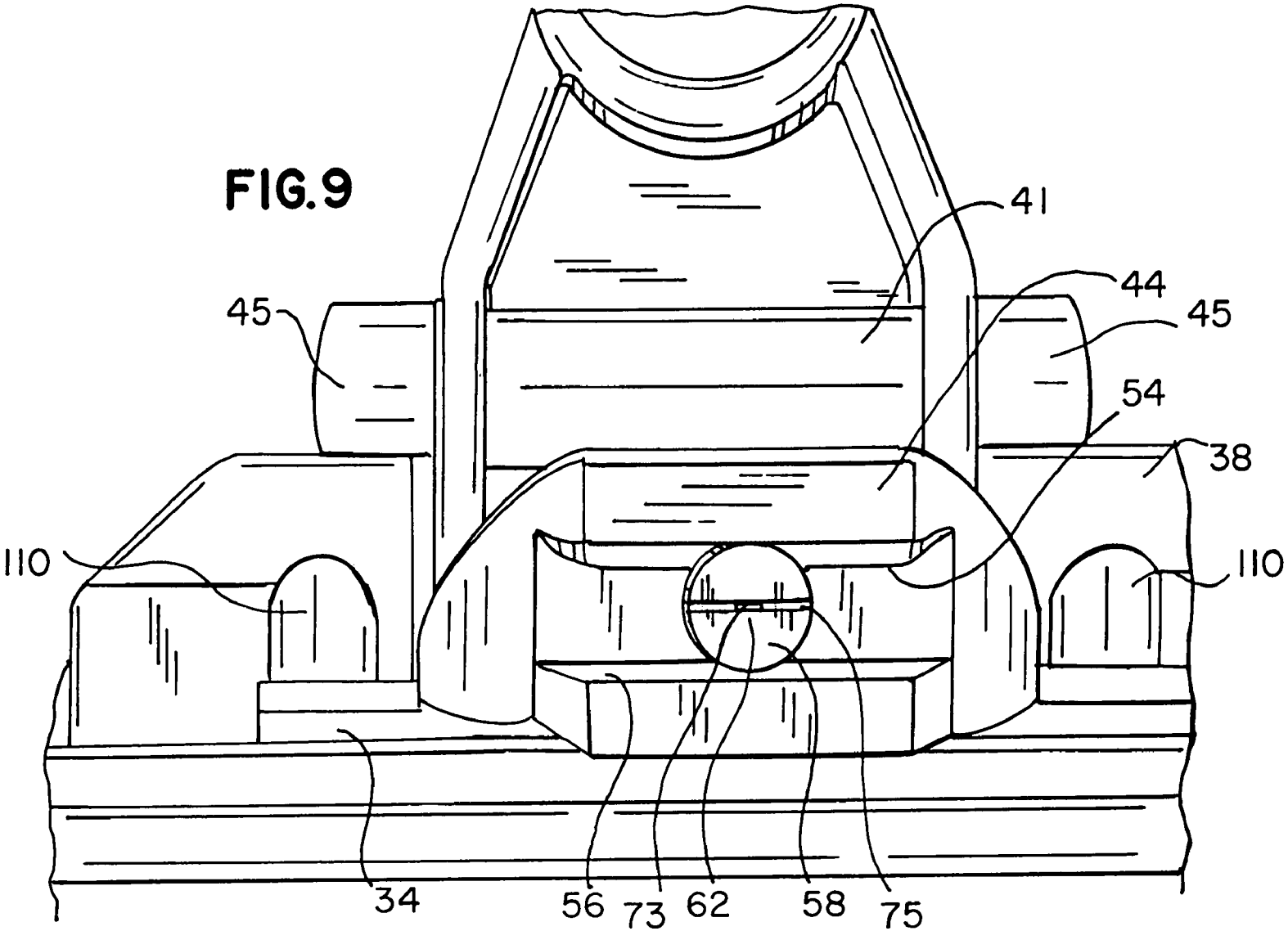
FIG. 9 is a front elevational view of the flat jet spray assembly of FIGS. 1-3, particularly showing the geometry of the horizontal emission slit of the spray nozzle and the position of the front of the spray nozzle within the slot-shaped spray jet outlet of the spray head.

As can be appreciated from FIGS. 1 and 8, retaining plate 34 has front and back enforcement rims 33*a* and 33*b*, respectively, which extend along the longitudinal extension of retaining plate 34 and slightly protrude upwardly from upper surface 36 of retaining plate 34. The front enforcement rim 33*a* is underneath the front portion 91 and in front of securing flange 98 of spray head 90. Retaining element 38 is positioned transversely about the middle between enforcement rims 33*a* and 33*b*. Retaining element 38 are two separated symmetrical parts having semi-circular upper portions. In a preferred embodiment, as shown in FIGS. 1, 2 and 8, in front of retaining element 38 there is a stopping element in the form of a pair of stoppers 110, each having an inclined upper end 112, inclined toward retaining element 38. As shown in FIGS. 2, 8 and 9, vertical pivot joint 41 has a center piece 43 and a pair of positioning flanges 45 protruding on the left and right sides of center piece 43. There is an opening 47 around the center near the bottom of center piece 43 for fluid feed tubing 31 to pass through (see FIG. 2). As shown in FIG. 8, when support shaft 22 is severely titled toward the front edge 35 of retaining plate 34, positioning flanges 45 of the vertical pivot joint 41 can be stopped by stoppers 110. This serves two functions. The stoppers 110 prevent the pivot joints to lean against spray head 90 when support shaft 22 is extensively tilted, and hence cause damage to the spray head. This also prevents severe bending of fluid feed tubing 31 and its consequential discontinuing supply of the cleaning fluid, which occurs when support shaft 22 is extensively tilted. It is noted that for the purpose of the present invention other suitable shapes or structures can also be used for the stopping element.

Figure 5C:
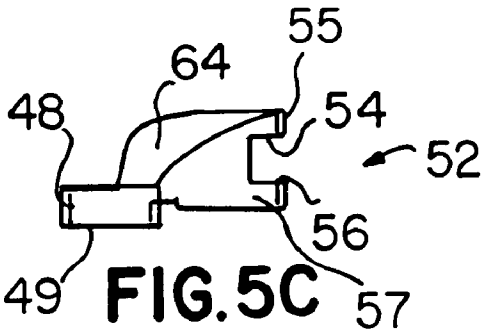
Figure 5B:
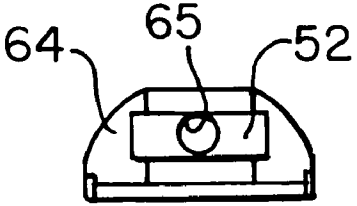

As shown in FIGS. 5 through 5C and 9, spray head 44 of one embodiment of the present invention has a securing flange 48 at a rear portion thereof, and a front portion 64 extending upward and forward from securing flange 48. Front portion 64 has a slot-shaped spray jet outlet 52, being open at the side edges, and having a rectangular, or U-shaped vertical cross-section. Slot-shaped spray jet outlet 52 has upper and lower surfaces 54 and 56, which are substantially parallel to each other. Furthermore, in approximately the middle of the slot longitudinal extension there is a channel, or through nozzle hole 65, for holding spray nozzle 58. Securing flange 48 has a pair of fastening openings 50 for attaching spray head 44 to retaining plate 34 by securing screws 46. Instead of threaded screws, in this case bayonet-type connections can also be provided for the rapid fitting and removal of spray head 44. Along the transverse axis 63 of spray head 44, which is in perpendicular to the longitudinal extension of slot-shaped spray jet outlet 52, there is a cut-out on the upper side, forming a planar mounting seat 60 for seating fluid feed tubing 31 and its connection interface with spray nozzle 58. As shown in FIG. 5C, base 49 of securing flange 48 is substantially planar.

Figure 6A:
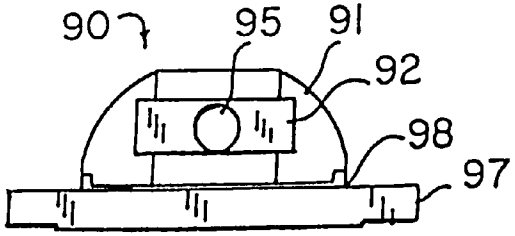
FIGS. 6-6C are a top elevational view, a front plan view, a side elevational view and a perspective view, respectively, of the spray head of one embodiment of the present invention.
Figure 6C:
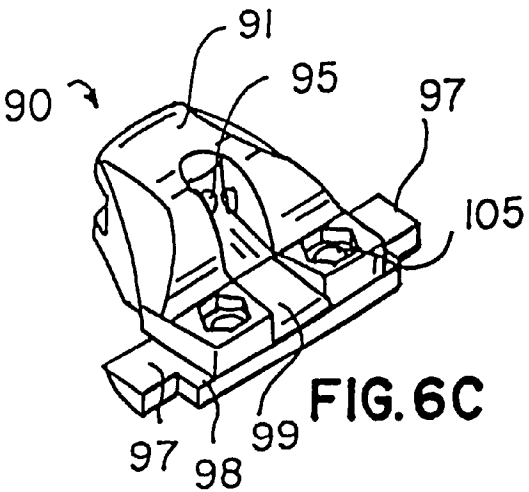
Figure 6B:
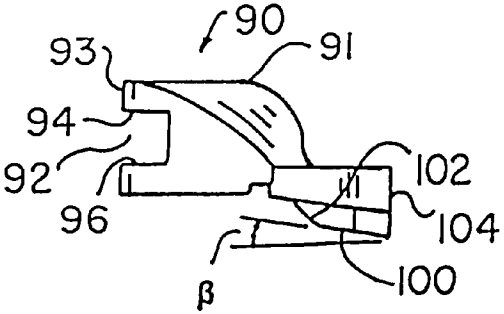
Figure 6:
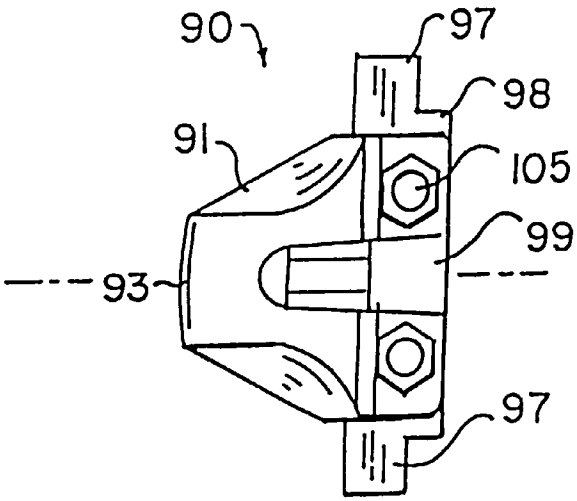

FIGS. 6 through 6C show the structure of spray head 90 in an alternative embodiment of the present invention. The structures of front portion 91 of spray head 90, including slot-shaped spray jet outlet 92 and its parallel upper and lower surfaces 94 and 96, and channel 95, as well as mounting seat 99 on the upper side of spray head 90 are the same as those of the corresponding components of spray head 44 described above. As shown, securing flange 98 of spray head 90 has extension portions 97 on both sides. When being installed, extension portions 97 are positioned directly against the pair of stoppers 110 in front of retaining element 38. As such, spray head 90 will not be dislocated, for example tilted left or right, when it is hit by obstacles from either side of the spray head during cleaning. Securing flange 98 has a pair of openings 105 for fastening spray head 90 to retaining plate 34.

As an important structural feature of spray head 90, extended securing flange 98 has an inclined base 100. As shown in FIG. 6B, from rear face 104 of securing flange 98, base 100 curves upwardly toward the front of spray head 90. There is an upward angle (β) between the horizontal ground to the inclined base 100, in a range between about 4 and about 10 degrees. It is noted that as the upper surface 36 of retaining plate 34 is substantially flat, the angle (β) can also be referred to the angle of the inclined base 100 relative to the upper surface of retaining plate 34, or other flat mophead. When being installed on retaining plate 34, inclined base 100 is positioned on upper surface 36 of retaining plate 34, with its curved front portion 102 against the rear portion of front enforcement rim 33*a*. In the embodiment shown, see FIG. 8, rear portion 8 of front enforcement rim 33*a* is curved, which is complementary to the curved front portion 102 of inclined base 100, and hence forming a stable interface. The degree of angle β controls the spray width of flat jet spray assembly 30, as further described in detail hereinafter.

Figure 10:
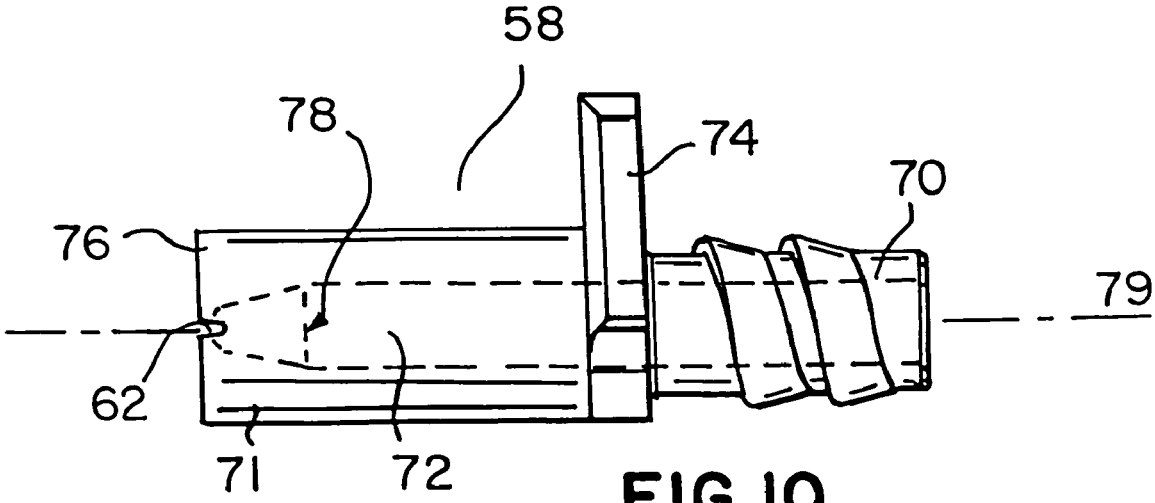
FIG. 10 is a side elevational view of the spray nozzle of flat jet spray assembly of the present invention.
Figure 11:
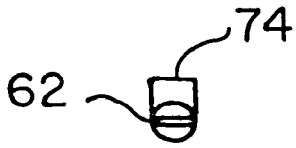
FIG. 11 is a front view of the spray nozzle of FIG. 10.
Figure 12:
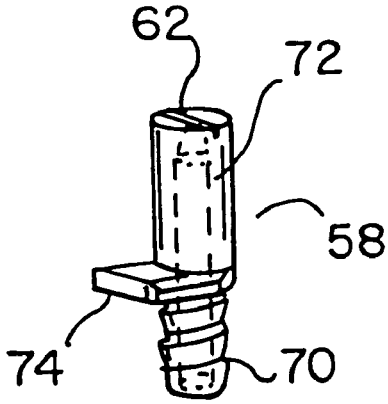
FIG. 12 is a rotated side elevational view of the spray nozzle of FIG. 10.

The structure and geometry of spray nozzle 58 may be more fully appreciated with reference to the views of FIGS. 9 and 10-13. As shown, spray nozzle 58 includes hollow body 71, through-channel 72, horizontal emission slit 62, locking flange 74 and tubing connection section 70. FIG. 10 shows the interior geometry of the through channel 72 by which cleaning fluid reaches horizontal nozzle aperture 73. That is, through channel 72 may be a right cylinder until plane 78 is reached. Thereafter, the through channel conically narrows into nozzle aperture 73 having the geometry shown in FIGS. 9-11. Horizontal emission slit 62 is formed by a central horizontal nozzle aperture 73, which is the opening of through-channel 72 on front face 76 of spray nozzle 58, and a horizontal slit 75 on front face 76 extending from nozzle aperture 73 through the entire width of front face 76, and opening on both side edges of front face 76, as shown in FIG. 9. Spray generated from horizontal emission slit 62 is in a fan shape, being flat in height. In the embodiment shown, horizontal emission slit 62 is aligned with longitudinal axis 79 of spray nozzle 58. However, an angle between horizontal emission slit 62 and longitudinal axis 79 can be provided for adjusting the direction and width of the spray. For example, by providing a positive angle between horizontal emission slit 62 and longitudinal axis 79, the spray is ejected with an upward angle, and the spray width generated on the floor is increased.

Locking flange 74 projects transversely from a longitudinal axis 79 of spray nozzle 58, which facilitates insertion of spray nozzle 58 into fluid feed tubing 31 and also assures proper positioning spray nozzle 58 within spray head 44. The location of lock flange 74 relative to front face 76 of spray nozzle 58 also assures precision in the axial location of spray nozzle 58 within channel 65, this as can be appreciated with reference to FIG. 14. In other words, in the absence of a means such as lock flange 74, an operator might inadvertently dispose spray nozzle either too far forward, or too far back relative to front end 55 of spray head 44, thereby undesirably affecting the dispersion pattern of the fluid and thus of the function of flat jet spray assembly 30.

Spray nozzle 58 is inserted into channel 65 from mounting seat 60 with lock flange 74 facing upward and horizontal emission slit 62 in horizontal position in parallel to slot-shaped spray jet outlet 52. FIG. 9 shows an enlarged front view of spray head 44 with spray nozzle 58 within slot-shaped spray jet outlet 52. The upper and lower surfaces 54 and 56 are above and below, and in parallel with horizontal emission slit 62 of spray nozzle 58. After installed in spray head 44, front face 76 of spray nozzle 58 is positioned with a distance, for example, 2 to 3 mm, inwardly from front face 55 of spray head 44. Therefore, spray nozzle 58 is protected at all directions by spray head 44, and the physical contacts with obstacles at the front face 55 of spray head during cleaning will not cause damage of spray nozzle 58. Moreover, the upper and lower surfaces 54 and 56 of slot-shaped spray jet outlet 52 further assures that spray 66 from spray nozzle 58 is substantially flat and projects only forward and laterally (left and right) of spray head 44. It is noted that the structural relationship between spray nozzle 58 and the spray head is described above using spray head 44, however, this relationship is the same with spray head 90.

Figure 13:
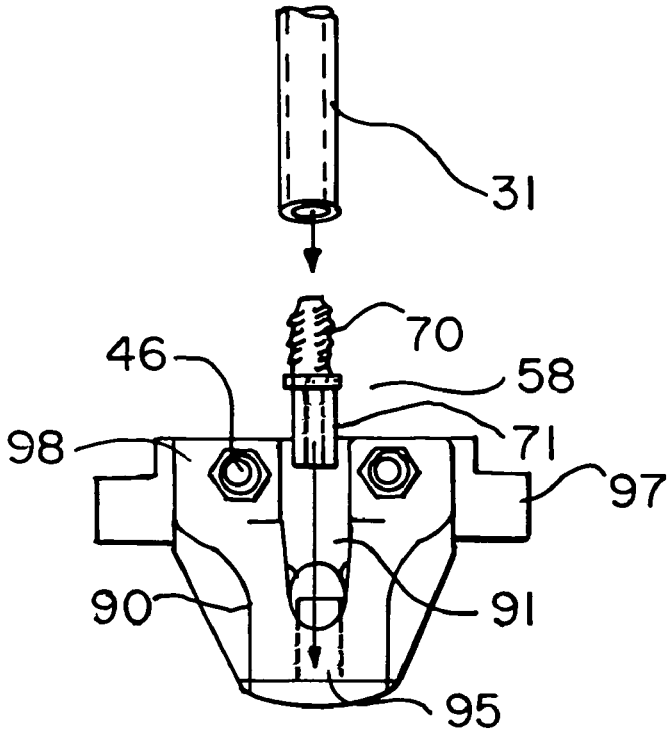
FIGS. 13 and 14 are sequential views showing the attachment of the spray nozzle to the fluid feed tubing and the fluid pathway of the spray nozzle.
Figure 14:
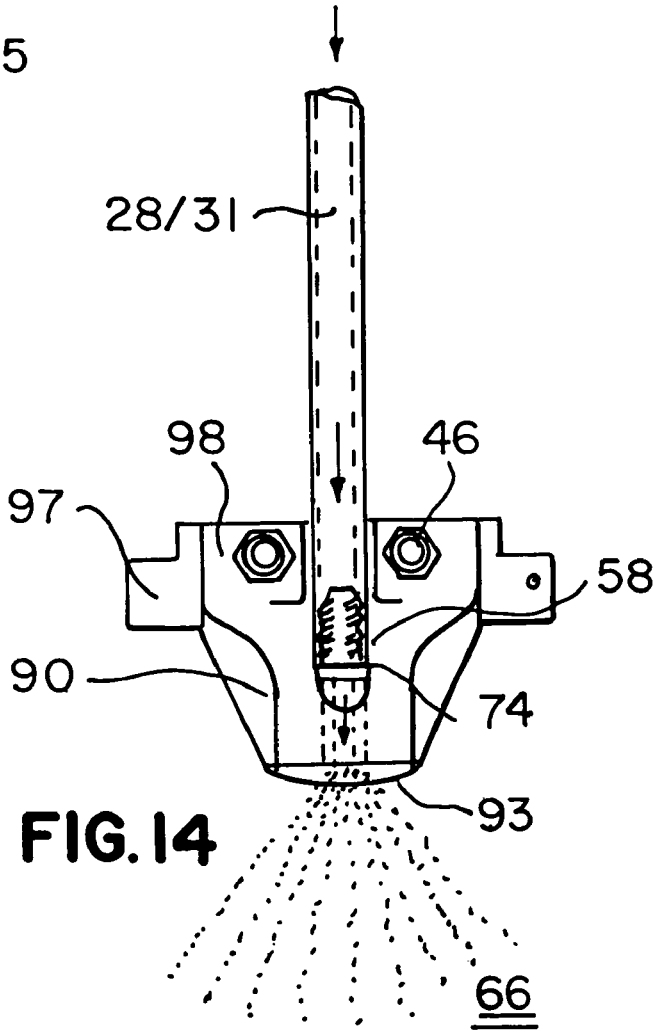

The outlet of fluid feed tubing 31 is connected to tubing connection section 70 of spray nozzle 58, the interface between fluid feed tubing 31 and spray nozzle 58 is seated on mounting seat 60. Fluid feed tubing 31 has an inlet connecting to fluid reservoir 24, and it fluidly communicates between fluid reservoir 24 and spray nozzle 58, as shown in FIGS. 3, 13 and 14.

In the embodiment shown, spray nozzle 44, or 90 is designed as a flat jet spray nozzle with a horizontal emission slit. In an alternative embodiment, the spray nozzle can be designed as a fan nozzle, and can have several jet outlets arranged at angles to one another. With each embodiment, widely diverging spray jets can be created which, at short distance, not only contact a sufficiently wide area of the floor in front of the retaining plate, but in the manner desired also create a flat, i.e., narrow in height spray jet. This is of major significance, because, as a result, specifically only an area close to the retaining plate can be wetted, and undesirable wetting of furniture of the like located beyond the cleaning area will be avoided.

Figure 7:
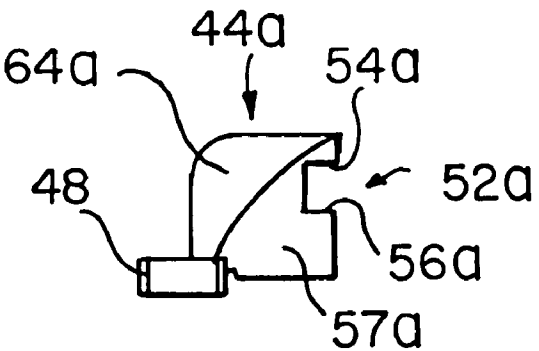
FIG. 7 is a view, similar to that of FIG. 5C, however showing that the lower front portion of the spray head can be provided with an enhanced vertical dimension.

Commonly used flat mops have three sizes, 22, 16 and 11 inches, in terms of the width of the mophead. The 22 and 16 inch flat mops are commonly used in commercial and residential cleaning, and the 11 inch flat mop is used for cleaning narrow areas. In commercial and industrial cleaning, about 32 inch flat mop is also used. Depending on the width of a retaining plate to be used, the width of spray generated by flat jet spray assembly 30 of the present invention can be adjusted between about 20 cm and about 80 cm, which match the width of the mophead. The extent of forward and lateral dispersion of the emissions of horizontal emission slit 62 of spray nozzle 58 can be found to be a function of several variables, namely, the angulation of spray head 44, or 90 relative to surface 22 to be cleaned, the height of spray nozzle 58 above cleaning surface 22, and rearward offset 68 (see FIG. 2) of the spray head from front edge 35 of retaining plate 34. For example, if slot-shaped spray jet outlet 52 of spray head 44 is tilted slightly downward, e.g. 2 degrees, relative to floor, the extent of both outward and lateral dispersion will be less than is the case if slot-shaped spray jet outlet 52 is completely parallel with the floor. Furthermore, if the height of the principal axis of horizontal emission slit 62 is increased relative to the floor, the outward and lateral extent of spray emission 66 is increased. In other word, the trajectory of the spray jet may be changed by either tilting slot-shaped spray jet outlet 52 slightly upwardly or downwardly or by increasing the height of the horizontal emission slit 62 relative to the floor. Change of trajectory and extent of lateral dispersion may also be accomplished by using spray head 44*a* of FIG. 7. In FIG. 7, lower jaw portion 57*a* exhibits a larger vertical dimension than that of portion 57 of FIG. 5C, thus elevating slot-shaped spray jet outlet 52*a* and spray nozzle 58, generating a wider spray width on the floor.

In a preferred embodiment, the spray width is controlled by using a spray head having an inclined base of the securing flange, such as the structure illustrated by spray head 90 shown in FIGS. 6B and 5C. As stated previously, the degree of angle β controls the spray width generated by the flat jet spray assembly. As angle β increases, slot-shaped spray jet outlet 92 of spray head 90 titles upward, which increases the spray width in front of the retaining plate. As angle β decreases, the spray width is narrowed. It has been found that by varying angle β between 5 and 9 degrees, the spray width can be controlled between 20 cm and 80 cm, which correspond to the width of flat mops from 11 inch to 32 inch. Therefore, a slight upward angulation of the slot-shaped spray jet outlet considerably increases outer and lateral dispersion, conversely, a slight downward angulation of spray head 90 considerably narrows the projection and lateral dispersion of the spray width. To this purpose, several spray heads 90 can be provided, each having a specific angle β. The user can select an appropriate spray head according to the width of the mophead. As can be appreciated, one uniform structure of spray nozzle 58, can be fitted to multiple spray heads.

Furthermore, the change of angulation can also be achieved by providing a shim-like insert underneath the spray head. The thickness, location, and direction of the insert, for example, provided underneath the front portion of the spray head, verses underneath the securing flange, will control the broadening or narrowing of the spray width. Furthermore, shim-like adjustment element can also be provided on the upper surface of the retaining plate, such as in front of the retaining element for the pivot means, as an integrated component of the retaining plate. In this configuration, the angulation is controlled by the shim-like adjustment element, and one uniform spray head can be used with different retaining plates which have different angle or height of the shim-like adjustment element.

In a further embodiment, the spray width can be adjusted by changing the angle of horizontal emission slit 62 to longitudinal axis 79 of spray nozzle 58, as described hereinabove. Therefore, as a different spray width is desired, the user can replace one spray nozzle with another which has a different angle between the emission slit and the longitudinal axis 79 of spray nozzle 58. To this purpose, several optionally usable spray nozzles can be provided for preference with spray widths of between about 20 cm and about 80 cm.

It should be understood that although the flat jet spray assembly of the present invention as described above have the spray head and the spray nozzle as two separate components, these components can also be made into one integrated structure, for example, by plastic molding. Furthermore, the spray head, spray nozzle and retaining plate can also be made into one integrated structure.

Using the above described approaches, adjustment to retaining plates of different widths can easily be achieved and the spray jet emerges onto the floor approximately in the width of the retaining plate, and is therefore already well distributed onto the surface so that further distribution of the cleaning fluid requires comparatively little effort.

Furthermore, because the spray head is secured to retaining plate 34 of flat mop 20, and is therefore arranged comparatively close to the ground, the excessive swirling of aerosols of the cleaning fluid is avoided, which can even lead to allergic reactions and the impairment of the health of the user. Furthermore, potential activity loss of the disinfection agents in air is also minimized.

It can be appreciated by those skilled in the art that although the flat jet spray assembly of the present invention has been described herein in detail using the structure of flat mop 20, the flat jet spray assembly can be used with other flat mops by installing the instant assembly on the upper side of the flat mophead, and connecting the fluid feed tubing to a available cleaning fluid reservoir or other suitable fluid supplier.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A cleaning device comprising: (a) a support shaft; (b) a retaining plate connected to a distal end of said support shaft by pivot means; (c) a cleaning pad detachably secured to a lower surface of said retaining plate; (d) a fluid reservoir attached to said support shaft, for storing cleaning fluid; and (e) a flat jet spray assembly secured upon said upper surface of said retaining plate, said flat jet spray assembly comprising: a spray head comprising a securing flange at a rear portion thereof; and a front portion having a slot-shaped spray jet outlet being open at side edges and a channel around a center of, and in perpendicular to, said slot-shaped spray jet outlet; a spray nozzle having a horizontal emission slit; said spray nozzle disposed within said channel of said spray head; and a fluid feed tubing having an outlet connecting to said spray nozzle, and having an inlet connecting to said fluid reservoir, fluidly communicating between said fluid reservoir and said spray nozzle; wherein said spray head has a planar mounting seat on an upper side thereof, extending from said rear portion to said channel, along a transverse axis of said spray head; and a tubing connection section of said spray nozzle that connects to said outlet of said fluid feed tubing on said mounting seat.

2. The cleaning device as recited in claim 1, wherein said pivot means are connected to said retaining plate by a retainer element, and said spray head is disposed in front of said retaining element inside an outline contour of said retaining plate, and within a width of said retaining element.

3. The cleaning device as recited in claim 1, wherein said slot-shaped spray jet outlet has a substantially rectangular or U-shaped vertical cross-section, and has opposing upper and lower substantially parallel surfaces above and below said horizontal emission slit of said spray nozzle.

4. The cleaning device as recited in claim 1, wherein said spray nozzle comprises a hollow body having a through-channel therein and said horizontal emission slit at a front face of said body in perpendicular to said through-channel; a locking flange above said hollow body, projecting transversely from a longitudinal axis of said spray nozzle, for positioning of said spray nozzle in said spray head; and a tubing connection section at a rear portion of said spray nozzle.

5. The cleaning device as recited in claim 4, wherein said spray nozzle is detachably inserted into said channel with said lock flange facing upward and said horizontal emission slit in parallel to said upper and lower surfaces of said slot-shaped spray jet outlet.

6. The cleaning device as recited in claim 1, wherein said securing flange of said spray head has an inclined base, and an angle between said inclined base and said upper surface of said retaining plate affects a spray width of said flat jet spray assembly.

7. The cleaning device as recited in claim 1, wherein said flat jet spray assembly produces a spray width of between about 20 cm and about 80 cm.

8. The cleaning device as recited in claim 1, wherein said flat jet spray assembly further comprises a shim insert to be positioned underneath said spray head for changing angulation of said spray head for adjusting a spray width.

9. The cleaning device as recited in claim 1, wherein said slot-shaped spray jet outlet of said spray nozzle has a height that can be selected to affect a spray width of said flat jet spray assembly.

10. The cleaning device as recited in claim 1, wherein said retaining plate has a shim adjustment element on said upper surface thereof for providing angulation of said spray head to obtain a desired spray width.

11. The cleaning device as recited in claim 1, wherein said spray nozzle is a fan nozzle, and has several jet outlets arranged at an angle to one another.

12. The cleaning device as recited in claim 1 further comprising a stopping element adjacent to said spray head for preventing said pivot means leaning against said spray head.

13. A flat jet spray assembly for providing a flat jet spray on a flat mop, comprising: (a) a spray head comprising a securing flange at a rear portion thereof; and a front portion having a slot-shaped spray jet outlet being open at side edges and a channel around a center of, and in perpendicular to, said slot-shaped spray jet outlet; (b) a spray nozzle having a horizontal emission slit; said spray nozzle disposed within said channel of said spray head; and (c) a fluid feed tubing having an outlet connecting to said spray nozzle, and having an inlet connecting to a fluid supplier; said flat jet spray assembly being secured upon an upper surface of a flat mophead; wherein said securing flange of said spray head has an inclined base, and an angle between said inclined base and said upper surface of said mophead affects a spray width of said flat jet spray assembly; said flat jet spray assembly further comprising multiple said spray heads, each having a difference in said angle between said inclined base and said upper surface of said mophead, and each of said spray heads enabling a different spray width.

14. The cleaning device as recited in claim 13, wherein said securing flange has an interface for securing said spray head to said flat mophead by fasten means in a detachable manner.

15. The flat jet spray assembly as recited in claim 13, wherein said slot-shaped spray jet outlet has a substantially rectangular or U-shaped vertical cross-section, and has opposing upper and lower substantially parallel surfaces above and below said horizontal emission slit of said spray nozzle.

16. The flat jet spray assembly as recited in claim 13, wherein said spray nozzle comprises a hollow body having a through-channel therein and said emission slit at a front of said body in perpendicular to said through-channel; a locking flange above said hollow body, projecting transversely from a longitudinal axis of said spray nozzle, for positioning of said spray nozzle in said spray head; and a tubing connection section at a rear portion of said spray nozzle.

17. The flat jet spray assembly as recited in claim 16, wherein said spray nozzle is detachably inserted into said channel with said lock flange facing upward and said emission slit in parallel to said upper and lower surfaces of said slot-shaped spray jet outlet.

18. The flat jet spray assembly as recited in claim 13 further comprising a shim insert to be positioned underneath said spray head for changing angulation of said spray head for adjusting a spray width.

19. The flat jet spray assembly as recited in claim 13, wherein said spray head has a planar mounting seat on an upper side thereof, extending from said rear portion to said channel, along a transverse axis of said spray head; and feed tubing on said mounting seat.

20. The flat jet spray assembly as recited in claim 13, wherein said flat jet spray assembly produces a spray width of between about 20 cm and about 80 cm.

21. The flat jet spray assembly as recited in claim 13 further comprising multiple said spray heads, each having a different angle of said horizontal emission slit of said spray nozzle, relative to said upper surface of said flat mophead, and each of said spray heads enabling a different spray width.

* * * * *